US011073797B2

(12) United States Patent
Bifrare et al.

(10) Patent No.: US 11,073,797 B2
(45) Date of Patent: Jul. 27, 2021

(54) REPEATER MECHANISM WITH TENSIONED CHAIN

(71) Applicant: Montres Breguet S.A., L'Abbaye (CH)

(72) Inventors: Christophe Bifrare, Le Pont (CH); Daniel Matteazzi, L'Orient (CH)

(73) Assignee: Montres Breguet S.A., L'Abbaye (CH)

( * ) Notice: Subject to any disclaimer, the term of this patent is extended or adjusted under 35 U.S.C. 154(b) by 485 days.

(21) Appl. No.: 16/143,795

(22) Filed: Sep. 27, 2018

(65) Prior Publication Data

US 2019/0196409 A1 Jun. 27, 2019

(30) Foreign Application Priority Data

Dec. 22, 2017 (EP) ..... 17209994

(51) Int. Cl.

| | |
|---|---|
| ***G04B 21/04*** | (2006.01) |
| ***G04B 23/03*** | (2006.01) |
| ***G04B 21/14*** | (2006.01) |
| ***G04B 21/02*** | (2006.01) |
| ***G04B 21/06*** | (2006.01) |
| ***G04B 21/12*** | (2006.01) |

(52) U.S. Cl.

CPC ..... *G04B 21/04* (2013.01); *G04B 21/027* (2013.01); *G04B 21/06* (2013.01); *G04B 21/12* (2013.01); *G04B 21/14* (2013.01); *G04B 23/03* (2013.01)

(58) Field of Classification Search

CPC ..... G04B 21/02; G04B 21/027; G04B 21/04; G04B 21/06; G04B 21/12; G04B 21/14; G04B 23/00; G04B 23/03

See application file for complete search history.

(56) References Cited

U.S. PATENT DOCUMENTS 8,873,347 B2 * 10/2014 Goeller ..... G04B 21/00 368/261
10,514,660 B2 * 12/2019 Behra ..... G04B 21/04

FOREIGN PATENT DOCUMENTS

CH 707 271 A2 5/2014
CH 707 273 A2 5/2014

OTHER PUBLICATIONS

European Search Report dated Jun. 8, 2018 in European Application 17209994.7, filed on Dec. 22, 2017 (with English Translation of Categories of cited documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A repeater mechanism includes: an hour part, which is mobile between a resting position and a reading position; an hour spring that returns the hour part towards its reading position; a chain that is hooked to the hour part; a barrel that includes a shaft, a drum, a spring, a pulley that is mobile in rotation relative to the shaft and on which the chain is hooked, and also a ratchet that is integral in rotation with the barrel shaft and coupled to the pulley as long as the hour part exerts a traction force on the chain, and uncoupled from the pulley as soon as this traction force is cancelled out; and a pulley spring that is interposed between the ratchet and the pulley.

10 Claims, 12 Drawing Sheets

REPEATER MECHANISM WITH TENSIONED CHAIN

This application claims priority from European Patent Application No. 17209994.7 filed on Dec. 22, 2017, the entire disclosure of which is hereby incorporated herein by reference.

TECHNICAL FIELD

The invention relates to the field of clockmaking. It concerns, more precisely, a repeater mechanism for a timepiece with a striking mechanism, the expression "timepiece" designating preferably a watch (wrist or fob), but likewise being able to designate a pendulum clock or even a clock.

TECHNOLOGICAL BACKGROUND

The repeater mechanism (currently simply named repeater) has the function, when actuated by the user (or wearer) exerting at any moment pressure on a push button, of striking the hour indicated at this moment by the hands of the timepiece.

The repeater is a clockmaking complication of extreme refinement, mastery of which does credit to the clockmaker who is at the origin thereof. Formerly intended for allowing the time to be known in darkness, the repeater today equips watches of great, or even very great value.

There are several types of repeater. In Les Montres Compliquées (Ed. Simonin, fifth edition, 2013), F. Lecoultre enumerates five thereof, but distinguishes essentially two (the most common):

The minute repeater which, apart from the hours, strikes all the minutes:

The quarter repeater which, apart from the hours, strikes the quarter(s) which have elapsed then the possible remaining minutes. Whatever the type, a repeater mechanism comprises as standard:

At least one hour snail;

At least one hour part bearing an hour feeler-spindle and mounted in rotation about an axis of the hours between:

- A resting position in which the hour feeler-spindle is offset angularly from the hour snail; and
- A reading position in which the hour feeler-spindle comes in contact with the hour snail;

A spring which returns the hour part towards its resting position;

And a striking mechanism barrel, coupled to the hour part.

In the absence of action by the wearer, the hour part is in its resting position.

Displacement of the push button causes a forced rotation of the striking mechanism barrel, the hour part being itself displaced towards its reading position in opposition to the spring.

Release of the push button is accompanied by return of the hour part towards its resting position. On the way, the hour part meshes (directly or indirectly) with a hammer striking a gong a number of times equal to the number of hours read on the snail and proportional to the angular course covered by the hour part between its two positions (reading, resting).

In the repeater, termed old-fashioned, coupling of the barrel to the hour part was effected by means of a rocker and a chain, as explained by F. Lecoultre (op. cit., pp. 68-69 and FIG. 19, Table 17).

This coupling has, in modern repeaters, been replaced by a rack and a wheel train, as explained likewise by F. Lecoultre (op. cit., pp. 73-74). Two opposing springs are provided: a barrel spring which forces the hour part towards its resting position, and an hour spring which forces it towards its reading position. Actuation of the spring by the wearer, whilst arming the barrel spring, frees the hour spring which returns the hour part towards its reading position. Releasing the spring frees, conversely, the barrel spring which returns the hour part towards its resting position (in opposition to the hour spring), whilst the striking mechanism of the hour is unwound.

This type of repeater does not give complete satisfaction because the motor torque exerted by the barrel spring is not constant. The result, during operation, is variations in the loads to which the hour part is subjected, which can generate in the latter mechanical fatigue cycles, conducive to cracking thereof.

Recently, an entirely new repeater mechanism has been proposed, which is fitted to the Breguet model 7087 "Tradition" watch and in which the wheel train is replaced by a chain transmission.

This transmission should not be confused with the chain of the old-fashioned repeater mentioned above because it functions inversely.

More precisely, in this repeater, the barrel comprises:

- A barrel shaft;
- A barrel drum,
- A barrel spring, an internal end of which is integral with the barrel shaft and an external end of which is integral with the barrel drum,
- A pulley on which the chain is wound.

The chain is hooked, by a proximal end, on the pulley and, by a distal end, on the hour part. In the absence of action by the wearer on the push button, the barrel spring tightens the chain which keeps the hour part in its resting position. Action of the wearer on a push button causes the forced rotation of the barrel shaft, which frees the chain and therefore the hour part, which is returned towards its reading position by the hour spring.

When the wearer releases the push button, the barrel spring, the motor torque of which exerted on the barrel shaft is greater than the resistant torque exerted by the hour spring on the hour part, returns the latter towards its resting position. On the way, the hour is struck.

The reading (and the striking) of the quarters and/or of the minutes follows the same principle, with a quarter snail (respectively minute) and a quarter part (respectively minute) bearing a quarter feeler-spindle (respectively minute) which is able to come, in a reading position, in contact with the quarter snail (respectively minute).

This mechanism has an advantage in terms of space and assembly. In fact, the chain, which makes the mechanical connection between the barrel and the hour part on the other hand, makes it possible to position them at a distance one from the other. It is thus possible, whatever the positioning of the hour part in the watch middle, to place the barrel nearest the push button, which avoids having to resort to complex lever returns, to the benefit of the operational reliability of the watch.

However, this chain mechanism has a disadvantage which results from the fact that it operates on an all-or-nothing basis, i.e. whatever the hour to be struck, the wearer fully depresses the push button. Consequently, the actuation of the barrel causes complete unwinding of the chain, whatever the angular course of the hour part. In the case (alone) where the hour to be read is 12h59 (which corresponds to the maximum course of the hour parts (if necessary the quarters) and the minutes, the chain remains tensioned. But in all other cases, the angular course of these parts is not at maximum and the remaining course of the chain (beyond that which it adopts in the reading position of the hour part) causes slackening thereof, and floating thereof.

Upon releasing the barrel, the barrel spring does not encounter any resistant force until the chain is again abruptly tensioned between it and the hour spring. The result is a peak in the tension force to which the chain is subjected, which can cause shearing fatigue in the axes of the connecting links of the chain or in its fixing point on the hour part.

Consequently, a first object, in a repeater mechanism with a chain as described above, is to minimise the mechanical fatigue of the mobile parts (in particular of the chain).

A second object is, more precisely, to smooth out the forces generated in the chain by the action of the barrel spring.

SUMMARY OF THE INVENTION

There is proposed, firstly, a repeater mechanism for a timepiece with a striking mechanism, which comprises:

An hour snail;

An hour part bearing an hour feeler-spindle and mounted in rotation about an hour axis between:

- A resting position in which the hour feeler-spindle is offset angularly from the hour snail;
- A reading position in which the hour feeler-spindle comes in contact with the hour snail;

An hour spring which returns the hour part towards its reading position;

A striking mechanism barrel, which comprises:

- A barrel shaft;
- A barrel drum,
- A barrel spring, an internal end of which is integral with the barrel shaft and an external end of which is integral with the barrel drum;
- A pulley;

A chain which is able to be wound up partially on the pulley, the chain being hooked, by a proximal end, on the pulley and, by a distal end, on the hour part.

This repeater mechanism being notable in that the pulley is mobile in rotation relative to the barrel shaft, and in that the striking mechanism barrel comprises:

A ratchet, integral in rotation with the barrel shaft and:

- Coupled in rotation with the pulley as long as the hour part exerts a traction force on the chain;
- Uncoupled in rotation from the pulley as soon as the traction force exerted on the chain by the hour part in the reading position is cancelled out;

A pulley spring interposed between the ratchet and the pulley, and which exerts on the latter a resistant torque which keeps the chain under tension when the ratchet is uncoupled in rotation from the pulley.

Consequently, the chain is always tensioned, whatever the hour to be struck. The result is a reduction in the mechanical fatigue which the chain (with the assembly of mobile components) undergoes in the course of time, to the benefit of the operational reliability (and the operational life) of the mechanism.

Secondly, there is proposed a watch equipped with a middle and such a repeater mechanism, mounted in the middle.

Various additional features, presented below, can be provided, alone or in combination.

Hence, the pulley spring is preferably a spiral spring, an internal end of which is integral with the ratchet, and an external end of which is integral with the pulley.

The pulley advantageously integrates a limit stop, and the ratchet integrates a tooth which is applied against the limit stop as long as the chain exerts a traction force on the pulley, and which is offset angularly therefrom as soon as the traction force exerted on the chain by the hour part in the reading position is cancelled out.

The repeater mechanism can furthermore comprise:

A rack mounted in rotation about an axis and provided with a toothed sector;

A striking mechanism train meshing, on the one hand, with the toothed sector of the rack and, on the other hand, with the barrel shaft.

In this case, the watch is advantageously equipped, apart from the middle and the repeater mechanism, with a push button mounted in translation on the middle between a disarmed position in which the push button does not exert a motor torque on the rack, and an armed position in which the push button exerts a motor torque on the rack which causes rotation of the barrel shaft via the striking mechanism train.

The striking mechanism train comprises, for example, an input pinion which meshes with the toothed sector of the rack, and an output pinion which is integral in rotation with the barrel shaft.

The striking mechanism train advantageously comprises a multiplier pinion which is integral in rotation with the input pinion and meshes with the output pinion.

The repeater mechanism can furthermore comprise a locking pawl which is in engagement with a toothed crown with asymmetrical toothing carried by the barrel drum.

The repeater mechanism can likewise be provided with a return bearing on which the chain runs between the striking mechanism barrel and the hour part.

BRIEF DESCRIPTION OF THE FIGURES

Other objects and advantages of the invention will appear in light of the description of an embodiment, given hereafter, with reference to the attached drawings in which.

DETAILED DESCRIPTION OF THE INVENTION

Figure 1:
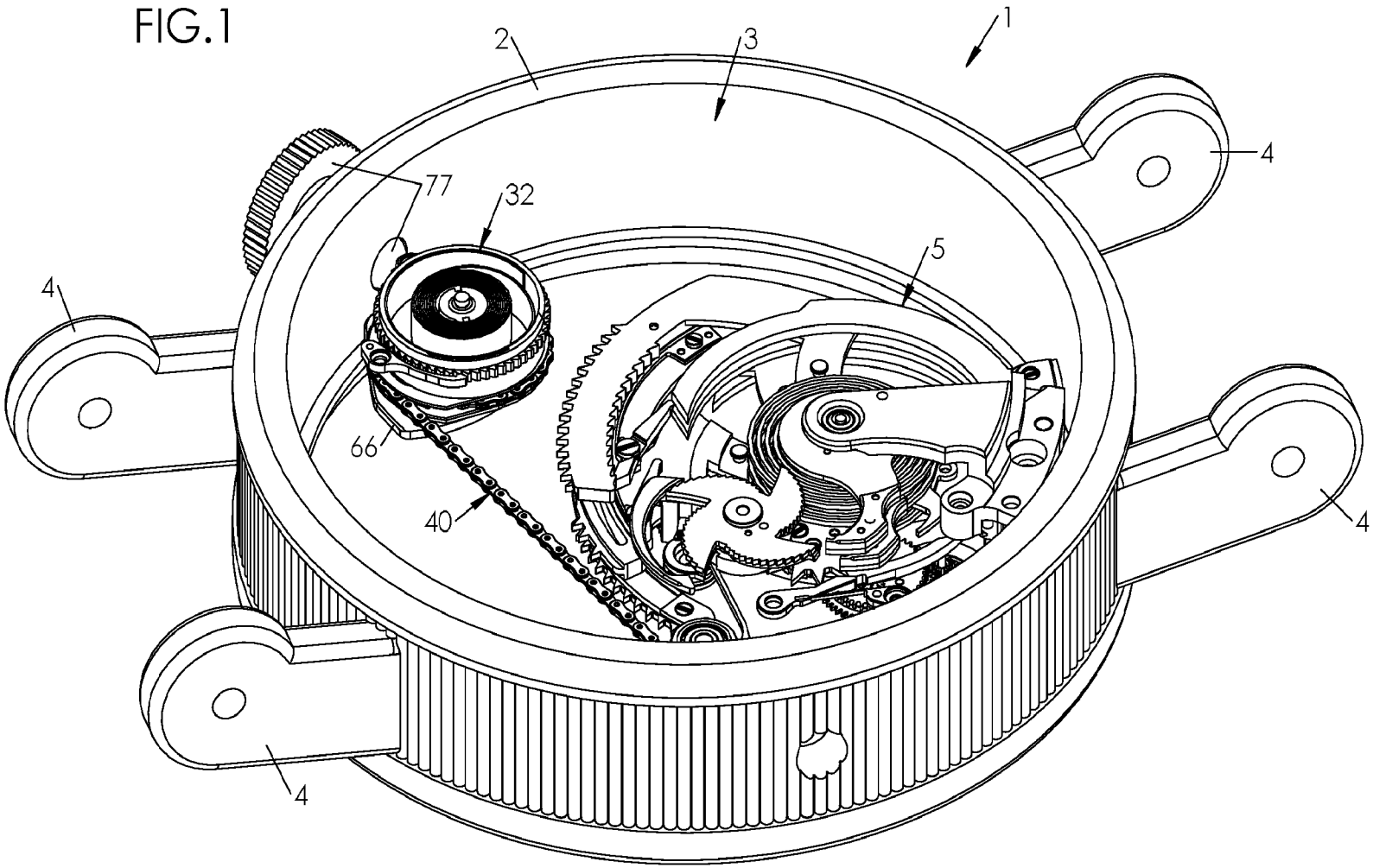
FIG. 1 is a perspective view from below showing partially a watch equipped with a repeater mechanism.

In FIG. 1, a timepiece is represented partially, in this case a watch 1. The watch 1 comprises a middle 2 which defines an internal volume 3. In the illustrated example, the watch 1 is designed for wearing on the wrist, and its middle 2 comprises, to this end, projecting horns 4, on which a strap (not illustrated) is intended to be fixed.

The watch 1 comprises a clock movement designed to indicate at least the hours and the minutes. The movement comprises a plate intended to be accommodated in the internal volume 3 defined by the middle 2, being fixed there.

The movement comprises furthermore various functional components brought together by sub-assemblies. When a sub-assembly has a different function from displaying the hours, the minutes and, if necessary, the seconds, it is termed "complication".

Hence, the timepiece (i.e. the watch 1) which is illustrated has a striking mechanism, and comprises, for the purposes of striking the current hour, a repeater mechanism, likewise termed "repeater complication" or, more simply (and as used hereafter), "repeater" 5.

The repeater 5 comprises, firstly, at least one hour snail 6. This snail 6 is mounted in rotation on an axis A1. It has a general spiral shape and comprises, on its periphery, a succession of twelve angular sectors of decreasing distances from the axis A1.

The hour snail 6 is integral in rotation with an hour star 7 which comprises twelve pointed teeth.

In the illustrated example, the repeater 5 likewise comprises a quarter snail 8, mounted in rotation about an axis A2. The quarter snail 8 comprises four angular sectors of decreasing distances from the axis A2, separated by smooth adjoining faces.

The repeater 5 comprises furthermore a minute snail 9, integral in rotation with the quarter snail 8 and which comprises four branches which are notched over their circumference, separated by smooth adjoining faces which extend in the extension of the adjoining faces of the quarter snail 8.

The quarter snail 8 bears, in the vicinity of its periphery, a finger which, upon each turn, comes to mesh with a tooth of the hour star 7 in order to turn the latter by a twelfth of a turn representing an advance of one hour.

The repeater 5 comprises, secondly, an hour part 10, mounted in rotation about an axis A3 and bearing an hour feeler-spindle 11.

The hour part 10 is mounted in rotation about its axis A3 between:

A resting position in which the hour feeler-spindle 11 is offset angularly from the hour snail 6; and A reading position in which the hour feeler-spindle 11 comes in contact with the hour snail 6.

Figure 3:
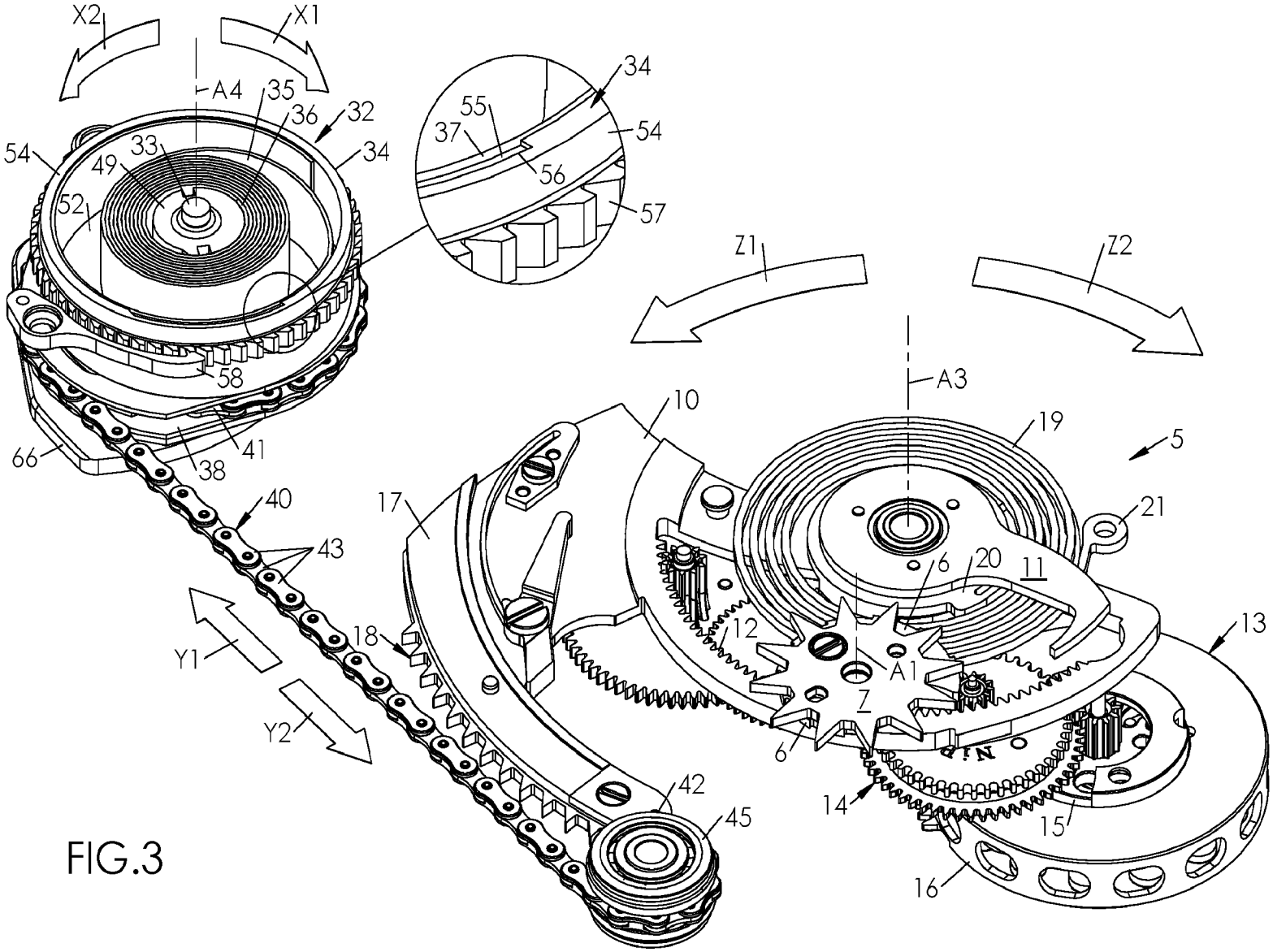
FIG. 3 is a view of the repeater mechanism, one part of its components removed for more clarity in the operation thereof.

As illustrated in FIG. 3, the hour part 10 comprises a toothed sector 12 which meshes with a regulator 13 via a multiplier train 14. In the illustrated example, the regulator 13 is magnetic; it comprises a rotor 15 mounted in rotation in a stator 16. The rotor 15 has a limit speed of rotation, determined by an equilibrium between the centrifugal force applied to the ferromagnetic mobile inertia blocs mounted on the rotor 15, and a counter-electromotor force generated in the inertia blocks by Foucault currents induced by an alternating magnetic field produced by pairs of magnets, with which the stator 16 is provided.

The hour part 10 comprises an exterior arm 17 provided with an hour rack 18 comprising twelve projecting teeth. During return of the hour part 10 from its reading position to its resting position, the hour rack 18 actuates an hour hammer (not illustrated) which comes to strike an hour gong tuned to a predetermined acoustic frequency, possibly amplified by a structural part of the watch 1 (e.g. the middle 2). The hour hammer strikes the hour gong a number of times (between one and twelve), equal to the number of teeth of the rack 18 which have actuated it during return of the hour part 10 from its reading position to its resting position.

The repeater 5 comprises, fourthly, an hour spring 19 which returns the hour part 10 towards its reading position. In the illustrated example, the hour spring 19 is a spiral spring. It is advantageously fixed on the hour part 10 by an internal end 20, and on an axis integral with the plate by an external end 21.

Figure 2:
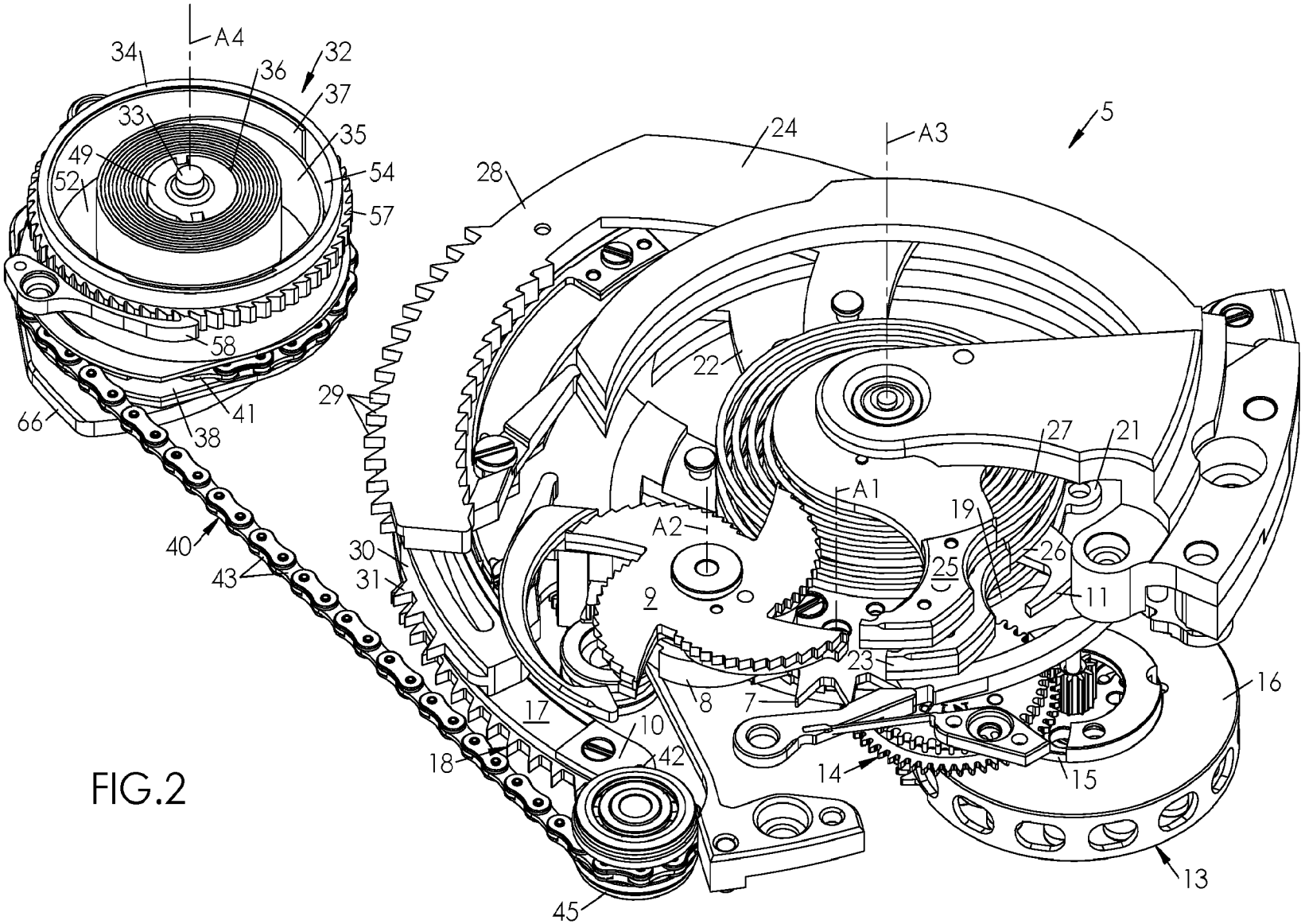
FIG. 2 is a perspective view of the repeater mechanism alone, on a larger scale.

The repeater 5 comprises, in the example illustrated in FIG. 2, a quarter part 22 bearing a quarter feeler-spindle 23 and mounted in rotation about the axis A3 between:

a resting position in which the quarter feeler-spindle 23 is offset angularly from the quarter snail 8; and a reading position in which the quarter feeler-spindle 23 comes in contact with the quarter snail 8.

The repeater comprises furthermore, in the example illustrated in FIG. 2, a minute part 24 bearing a minute feeler-spindle 25 and mounted in rotation about the axis A3 between:

a resting position in which the minute feeler-spindle 25 is offset angularly from the minute snail 9; and a reading position in which the minute feeler-spindle 25 comes in contact with the minute snail 9.

The repeater 5 likewise comprises a quarter spring 26 which returns the quarter part 22 towards its reading position, and a minute spring 27 which returns the minute part 24 towards its reading position.

The minute part 24 is provided, on an exterior arm 28, with a minute rack 29 comprising fourteen projecting teeth. During return of the minute part 24 from its reading position to its resting position, the minute rack 29 actuates a minute hammer (not illustrated) which comes to strike a minute gong tuned to a predetermined acoustic frequency which is different (e.g. lower) than the acoustic frequency of the hour gong. The minute hammer strikes the minute gong a number of times (between zero and fourteen), equal to the number of teeth of the minute rack 29 which have actuated it during return of the minute part 24 from its reading position to its resting position.

The quarter part 22 is provided, on an exterior arm 30, with a quarter rack 31 comprising three series of projecting teeth. During return of the quarter part 22 from its reading position to its resting position, the quarter rack 31 actuates, almost simultaneously, the hour hammer and the minute hammer in order to generate a close sequence of two notes. The hour hammer and the minute hammer strike their respective gongs a number of times (between zero and three), equal to the number of series of teeth of the quarter rack 31 which have actuated them during return of the quarter part 22 from its reading position to its resting position.

As is seen in FIG. 2, the hour part 10, the quarter part 22 and the minute part 24, mounted in rotation on the same axis A3, are offset angularly one relative to the other such that, during their integral rotation about the axis A3, the readings take place successively in the following order: minutes; quarters; hours. Striking is however effected in the inverse order: hours; quarters; minutes.

The repeater 5 comprises, fifthly, a striking mechanism barrel 32.

The striking mechanism barrel 32 is mounted in rotation about an axis A4 of the barrel. The striking mechanism barrel 32 is a sub-assembly which comprises several components, amongst which:

A barrel shaft 33;

A barrel drum 34;

A barrel spring 35, an internal end 36 of which is integral with the barrel shaft 33 and an external end 37 of which is integral with the barrel drum 34; and A pulley 38.

The barrel shaft 33, the barrel drum 34 and the pulley 38 are all three mounted in rotation about the axis A4 of the barrel. These components are described in detail further on.

According to a preferred embodiment, the pulley defines a peripheral cam path 39.

The repeater 5 comprises, sixthly, a chain 40 which is able to be wound up partially on the pulley 38. More precisely, the chain is able to be wound up on the cam path 39. The chain 40 is hooked, by a proximal end 41, on the pulley 38 and, by a distal end 42, on the hour part 10.

The chain 40 comprises a plurality of links 43 which are articulated one relative to the other. The link 43 situated at the proximal end 41 of the chain 40 is fixed on a pin 44 which is integral with the pulley 38. The link 43 situated at the distal end 42 of the chain 40 is, per se, fixed on a pin (not visible) which is integral with the exterior arm 17 of the hour part 10.

According to one embodiment illustrated in FIG. 2 and FIG. 3, the repeater 5 comprises a return bearing 45 on which the chain 40 runs, between the striking mechanism barrel 32 and the hour part 10. This return bearing 45 advantageously appears in the form of a bearing (e.g. ball bearing).

Figure 4:
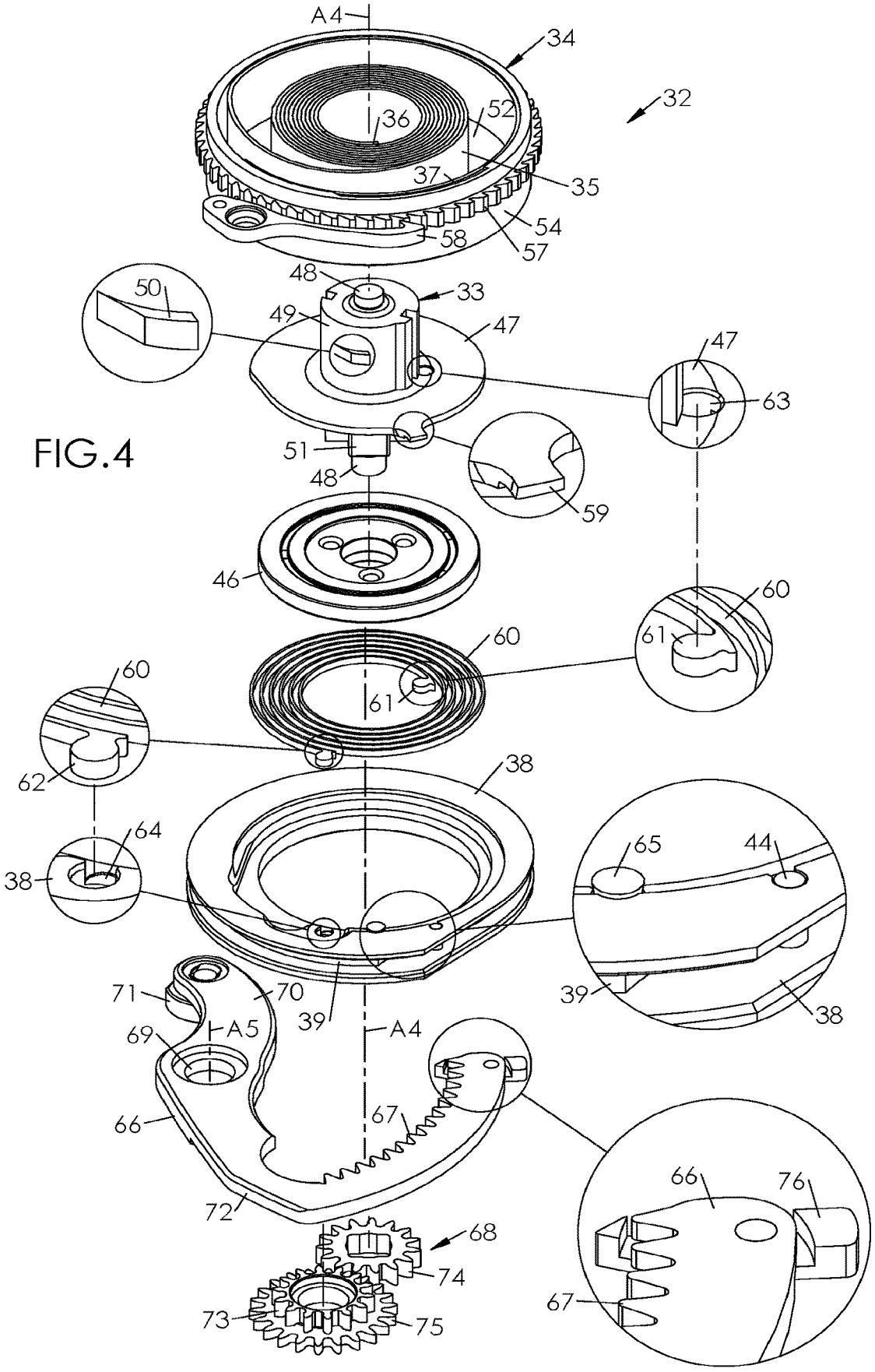
FIG. 4 is an exploded perspective view of the striking mechanism barrel of the repeater mechanism, with some details on a larger scale, shown in various insets.
Figure 5:
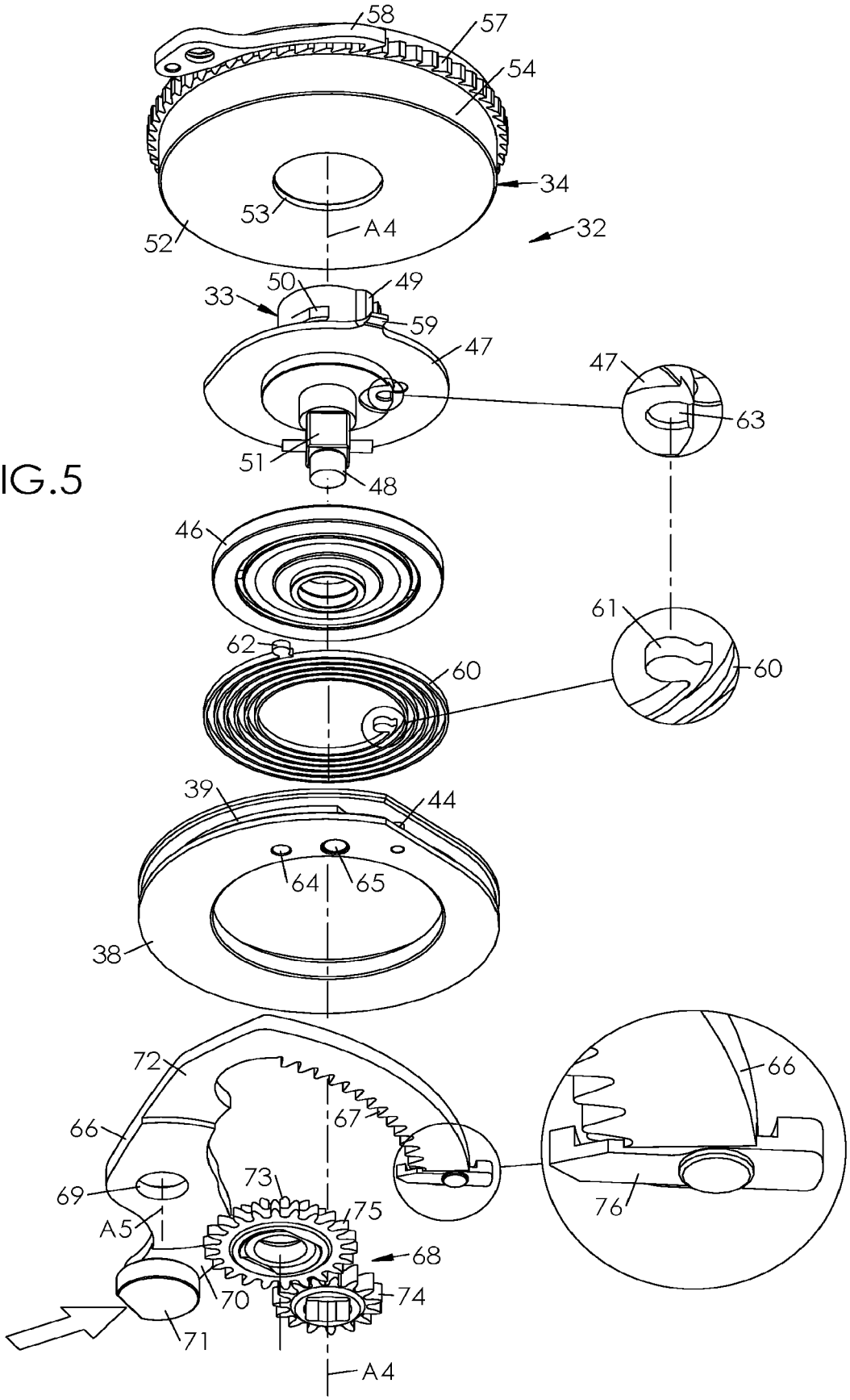
FIG. 5 is an exploded perspective view of the striking mechanism barrel of FIG. 4, according to another viewing angle.
Figure 8:
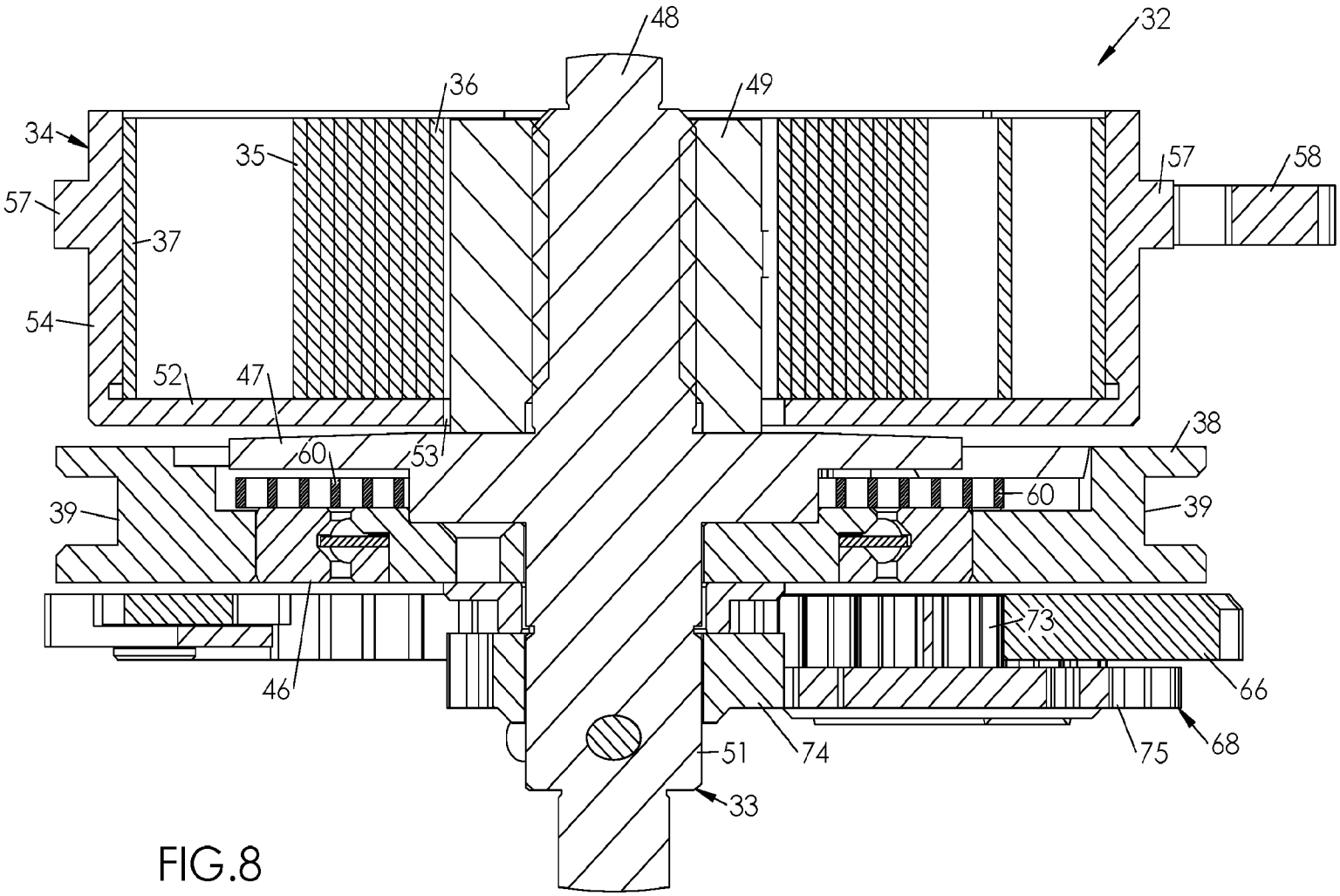
FIG. 8 is a sectional view of the complete striking mechanism barrel, according to the sectional plane VIII-VIII of FIG. 7.

As seen in FIG. 4, FIG. 5 and FIG. 8, the pulley 38 is a part separate from the barrel drum 34 and from the barrel shaft 33. More precisely, the pulley 38 is mobile in rotation relative to the barrel shaft 33.

According to one embodiment illustrated in FIG. 4 and FIG. 5, the striking mechanism barrel 32 comprises a bearing 46 (e.g. ball bearing) interposed between the barrel shaft 33 and the pulley 38.

As seen in FIG. 4 and FIG. 5, the striking mechanism barrel 32 comprises a ratchet 47, integral in rotation with the barrel shaft 33. This ratchet 47:

Is coupled in rotation with the pulley 38 as long as the hour part 10 exerts a traction force on the chain 40;

Is uncoupled in rotation from the pulley 38 as soon as the traction force exerted on the chain 40 by the hour part 10 in the reading position is cancelled out.

According to one embodiment illustrated in the drawings, the barrel shaft 32 comprises a pivot 48 and an arbor 49 (which can be mounted on the pivot 48 or formed with the latter in monobloc form) on which the barrel drum 34 is mounted. The arbor 49 is provided externally with a hook 50 to which the internal end 36 of the barrel spring 35 is fixed.

The pivot 48 has, at one end opposite the arbor 49, a head 51 with a square section.

The barrel drum 34 comprises a base 52 pierced, in its centre, by a hole 53 through which the barrel drum 34 is threaded (with clearance) on the arbor 49, and a skirt 54 which projects axially from the base 52, on the periphery of the latter. The external end 37 of the barrel spring 35 is fixed on the skirt 54, e.g. by means of an excess thickness 55 formed on the barrel spring 35 (possibly in the form of a mounted and welded blade) housed in a notch 56 which is hollowed into the internal wall of the skirt 54.

As illustrated in FIG. 2 to FIG. 5, the barrel drum 34 bears, on its periphery (and more precisely, in the illustrated example, on the periphery of its skirt 54), a toothed crown 57 with asymmetrical toothing, and the repeater 5 comprises a locking ratchet 58 in engagement with this toothed crown 57, in order to lock the rotation of the barrel drum 34 in the unwinding direction of the chain 40.

According to a preferred embodiment illustrated in FIG. 8, the ratchet 47 is formed integrally with the pivot 48. The ratchet 47 advantageously has the form of a disc. In the illustrated example, the ratchet 47 integrates a tooth 59. As seen clearly in FIG. 7, FIG. 10 and FIG. 12, the tooth 59 projects, radially, from the periphery of the ratchet 47.

The striking mechanism barrel 32 comprises a pulley spring 60, operating in torsion and interposed between the ratchet 47 and the pulley 38, and which exerts, on the latter, a resistant torque which keeps the chain 40 under tension when the ratchet 47 is uncoupled in rotation from the pulley 48.

Figure 7:
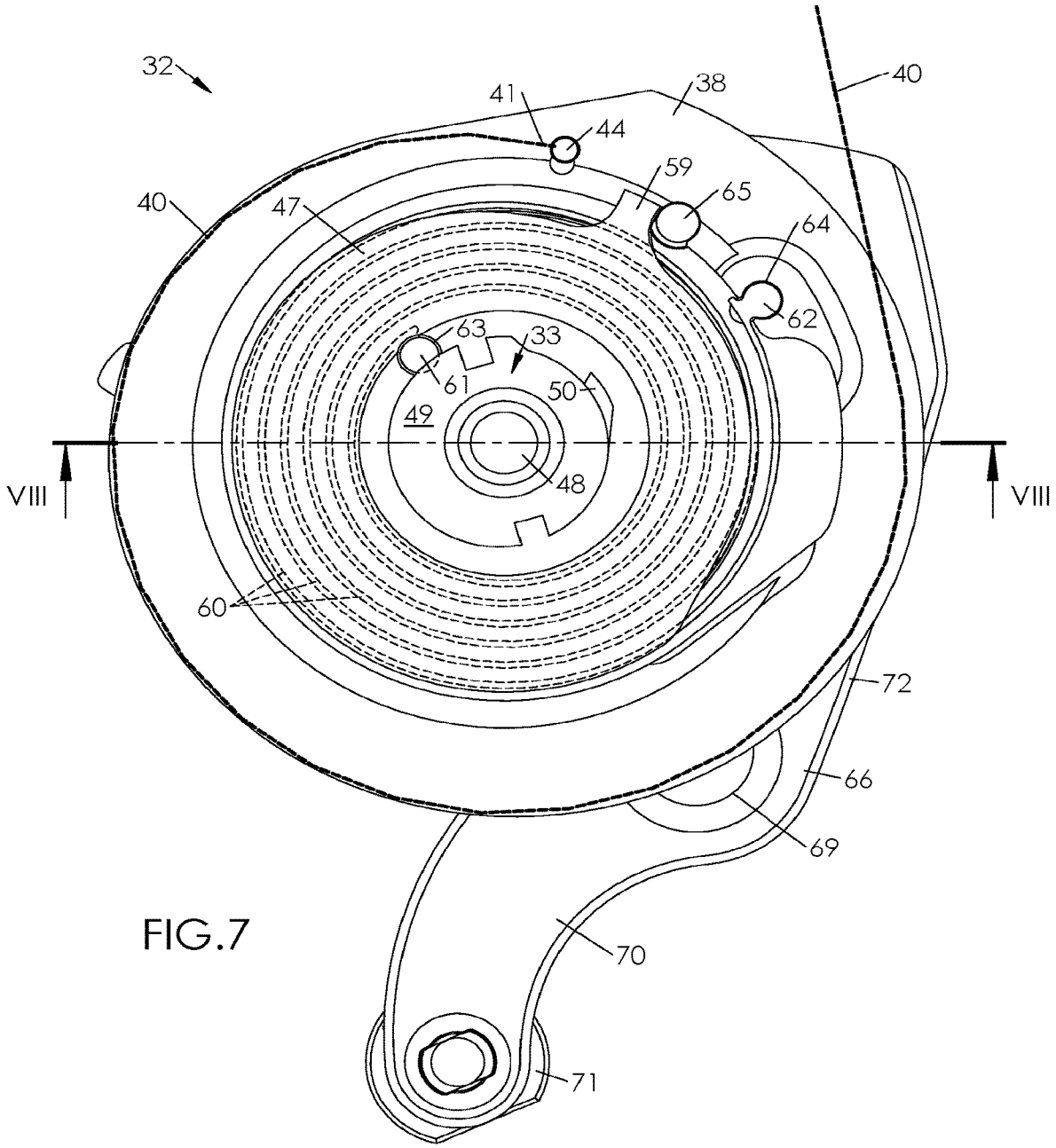
FIG. 7 is a plan view from below of the striking mechanism barrel, in its disarmed configuration.
Figure 10:
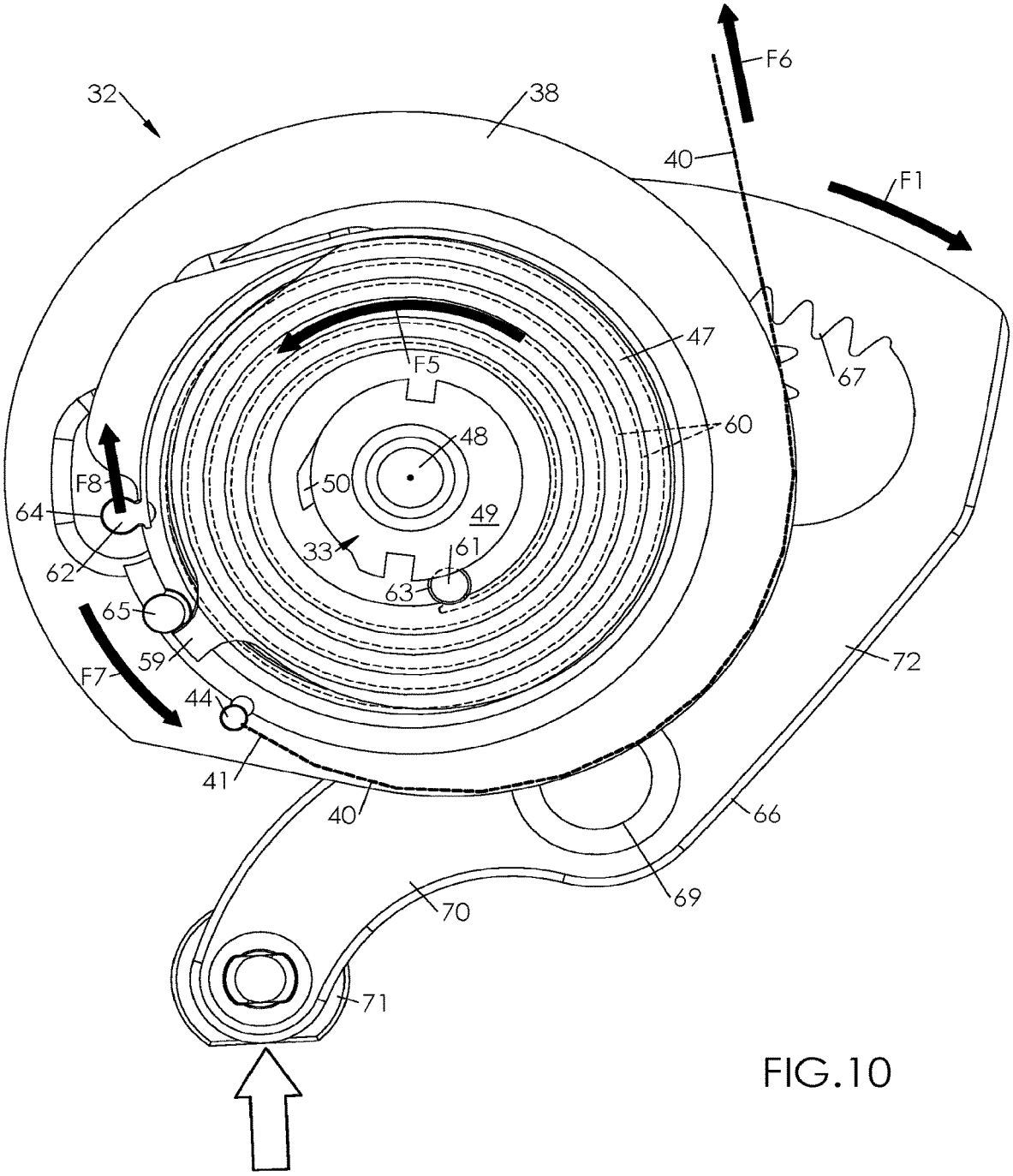
FIG. 10 is a plan view from below of the striking mechanism barrel (partially uncovered), in its partial armed configuration.
Figure 12:
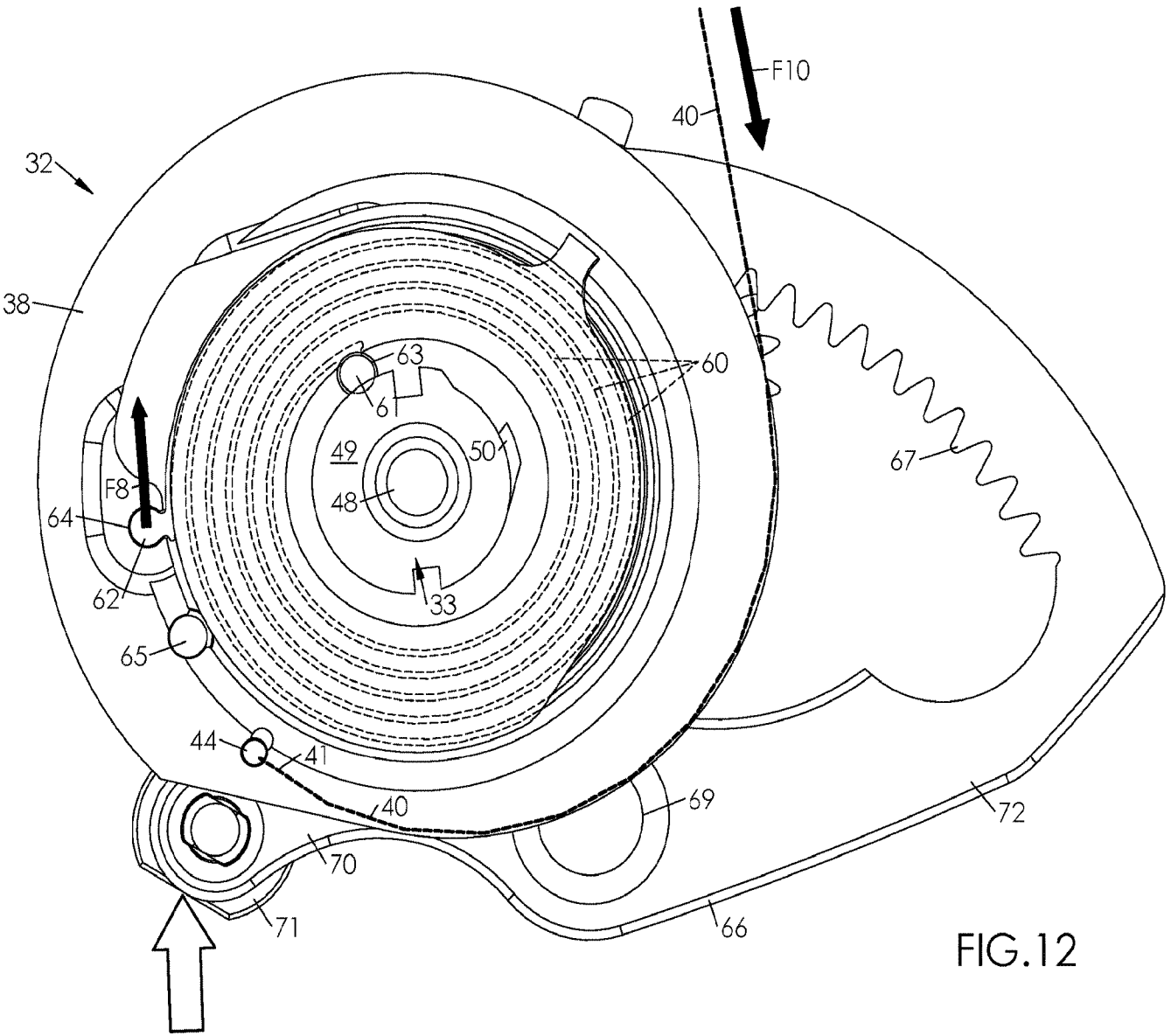
FIG. 12 is a plan view from below of the striking mechanism barrel (partially uncovered), in its total armed configuration.

According to a preferred embodiment illustrated in FIG. 7, FIG. 10 and FIG. 12. the pulley spring 61 is a spiral spring, an internal end 61 of which is integral with the ratchet 47, and an external end 62 of which is integral with the pulley 38. The pulley spring 60 can be manufactured in high-yield point steel. As a variant it can be produced in silicon.

In the illustrated example, the internal end 61 of the pulley spring 60 is shaped as a first stud which is fitted in a complementary notch 63 formed in the ratchet 47 (see the detail circles at the top and to the right in FIG. 4). Furthermore, the external end 62 of the pulley spring 60 is shaped as a second stud which is fitted in a complementary notch 64 formed in the pulley 38 (see the detail circles to the left in FIG. 4).

As illustrated in FIG. 4, FIG. 7, FIG. 10 and FIG. 12, the pulley 38 integrates a limit stop 65. This limit stop 65 is for example formed in the vicinity of the periphery of the pulley 38. In the illustrated example, the limit stop 65 is in the form of a mounted pin, driven into a boring provided in the pulley 38.

The tooth 59 of the ratchet 47 is applied against the limit stop 65 as long as the chain 40 exerts a traction force on the pulley 38. Inversely, the tooth 59 of the ratchet is offset angularly from the limit stop 65 as soon as the traction force exerted on the chain 40 by the hour part 10 in the reading position is cancelled out.

As represented in FIG. 4 and FIG. 5, the repeater 5 comprises, seventhly:

A rack 66 mounted in rotation about an axis A5 of the fixed rack, and provided with a toothed sector 67;

A striking mechanism train 68, meshing, on the one hand, with the rack 66 and, on the other hand, with the barrel shaft 33.

The rack 66 has the shape of a hook. The rack 66 is provided with a boring 69 by which it is mounted on its axis A5. On both sides of this boring 69, the rack 66 comprises a lever 70 bearing at its end a button 71 (which, in the illustrated example, is mounted and driven into a hole formed in the end of the lever 70), and a bent arm 72 in which the toothed sector 67 is formed.

Figure 11:
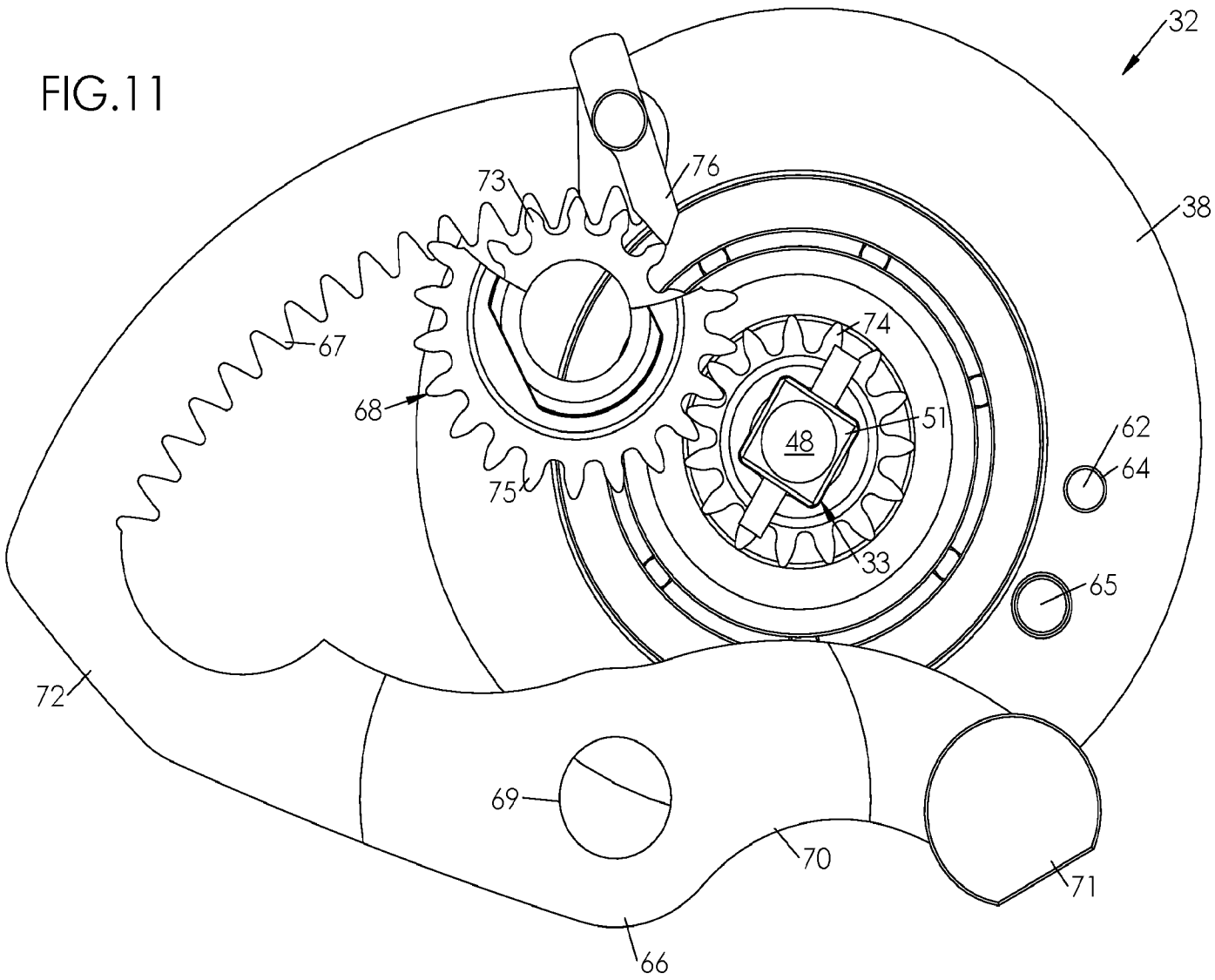
FIG. 11 is a plan view from above of the striking mechanism barrel, in a total armed configuration corresponding to total unwinding of the chain.

The rack 66 is mounted in rotation about its axis A5 between a resting position (FIG. 6) and a complete armed position (FIG. 11).

According to one embodiment illustrated in FIG. 4, FIG. 5, FIG. 6, FIG. 9 and FIG. 11, the striking mechanism train 68 comprises an input pinion 73 which meshes with the rack 66, and an output pinion 74 which is integral in rotation with the barrel shaft 33 (to this end, the pinion 74 is for example provided, in its centre, with a square recess which is complementary to the head 51 of the barrel shaft 33).

In the illustrated example, the striking mechanism train 68 comprises furthermore a multiplier pinion 75 (partially opened up in FIG. 6, FIG. 9 and FIG. 11), integral in rotation with the input pinion 73 and meshing with the output pinion 74.

The rack 66 and the pinions 73, 74, and 75 of the striking mechanism train 68 are dimensioned and fitted so that the total angular course of the rack 66 between its resting position and complete armed position corresponds to an almost complete turn of the pulley 38, causing almost total unwinding of the chain 40 from the cam path 39.

In the illustrated example, the rack 66 comprises twelve teeth (nine and a half of which are used during the course of the rack 66 between the resting position and the complete armed position); the input pinion 73 comprises fourteen teeth; the multiplier pinion 75 comprises twenty-two teeth and the output pinion 74 comprises fifteen teeth. Consequently, the transmission ratio between the rack 66 and the output pinion (i.e. the barrel shaft 33, and therefore the ratchet 47) is 0.99. In other words, in the total course of the rack 66 (between its resting position and its complete armed position) corresponds to one rotation of the ratchet by 358°.

Figure 6:
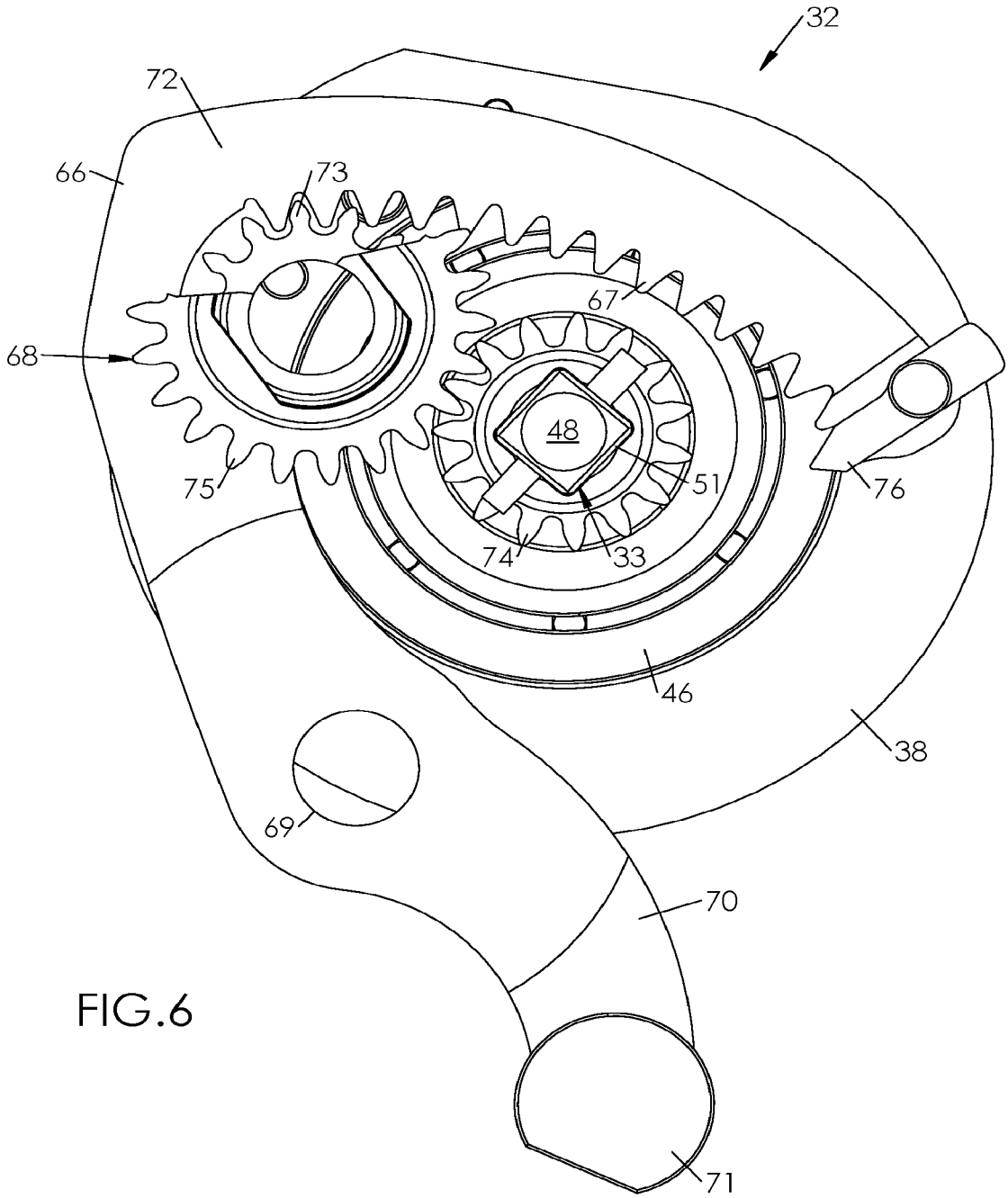
FIG. 6 is a plan view from above of the striking mechanism barrel (partially uncovered for more clarity), in a disarmed configuration.
Figure 9:
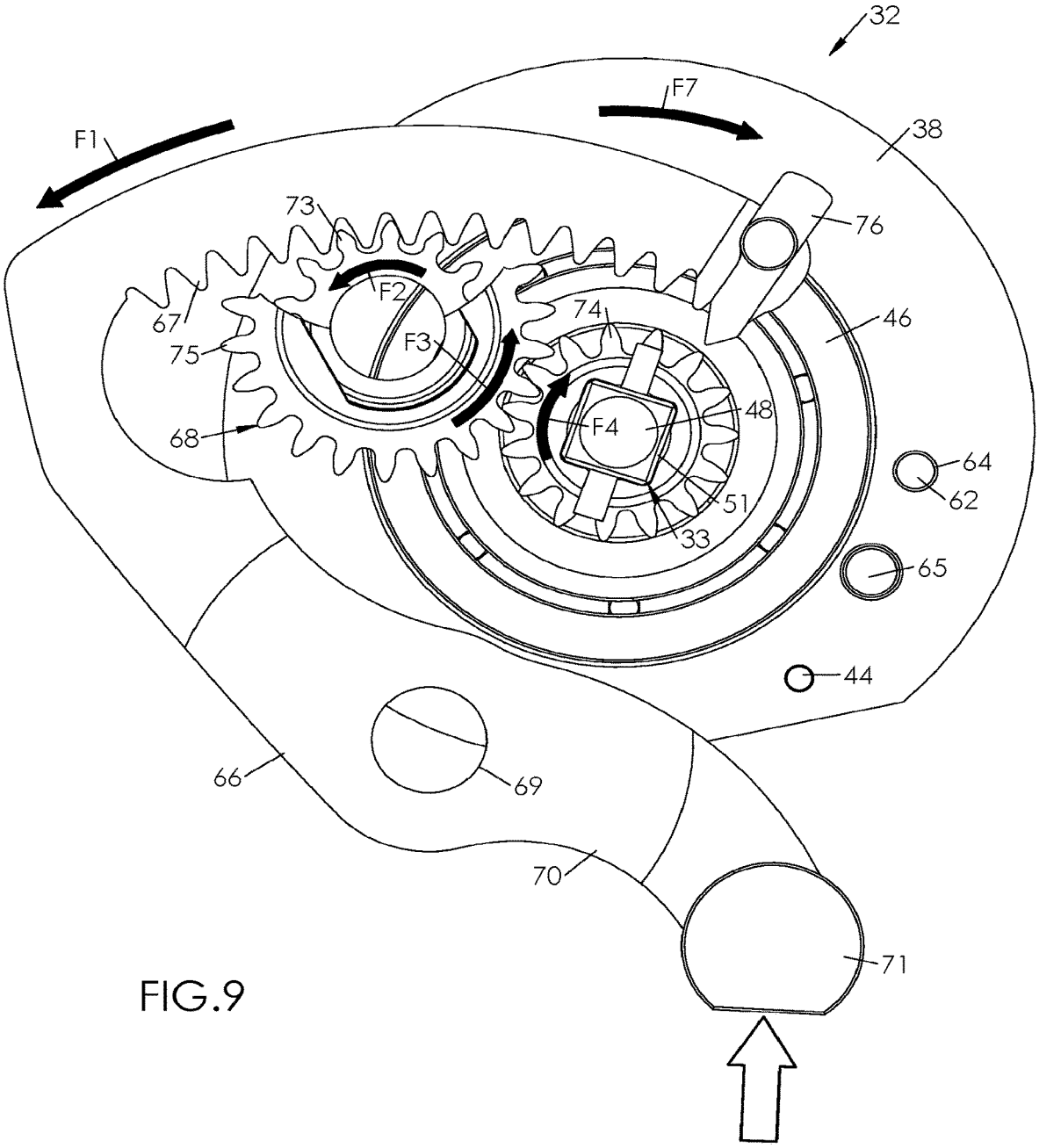
FIG. 9 is a plan view from above of the striking mechanism barrel, in a partially armed configuration corresponding to partial unwinding of the chain.

As seen in the detail inset at the bottom on the right in FIG. 4, and likewise in FIG. 6, FIG. 9 and FIG. 11, the rack 66 is advantageously provided, at the free end of the toothed sector 67, with a limit stop 76 which here has the form of a mounted driven-in part, and which, in complete armed position of the rack 66, comes to abut against the input pinion 73 which thus forms a limit stop at the end of travel for the latter.

According to a preferred embodiment, the limit stop 76, although mounted locked by being driven in, can tolerate an angular clearance so as to form an eccentric which allows the clockmaker to control precisely the angular position of the rack 66 (and therefore the corresponding angular position of the ratchet 47) at the end of travel into its complete armed position.

As illustrated in FIG. 1, the watch 1 is equipped with a push button 77. This push button 77 is mounted in translation relative to the middle 2 between:

a disarmed position in which the push button 77 exerts no motor torque on the rack 66, and an armed position in which the push button 77 exerts a thrust on the rack 66 (indicated by the white arrows at the bottom in FIG. 9, FIG. 10 and FIG. 12) generating a motor torque which causes rotation of the barrel shaft 33 via the striking mechanism train 68.

The repeater 5 operates in the following manner, it being understood that the barrel drum 34, retained by the locking ratchet 58, can turn about the axis A4 of the barrel only in the direction indicated by the arrow X1 (FIG. 3).

The rack 66 is permanently returned towards its resting position by the torsion force of the barrel spring 35 which is wound by force on the axis 33 of the barrel.

As long as no pressure is exerted on the push button 77, the rack 66 occupies its resting position. As the external end 37 of the barrel spring 35 is fixed, since it is integral with the barrel drum 34, itself retained by the ratchet 58 in engagement with the toothed crown 57, the barrel spring 35 exerts on the barrel shaft 33 a motor torque in the direction of the arrow X1 (FIG. 3). We have seen that the ratchet 47 is integral in rotation with the barrel shaft 33. This torque is therefore transmitted to the ratchet 47, the tooth 59 of which comes to be applied (in clockwise direction in FIG. 7) on the limit stop 65, with which the pulley 38 is provided. Consequently, the motor torque is transmitted to the pulley 38, which thus exerts traction on the chain 40 (in the direction indicated by the arrow Y1 in FIG. 3), the force of which traction is determined by the relationship of the motor torque produced by the barrel shaft 33 to the radius of the pulley 38 at the place where the chain leaves it.

This traction force, much greater than the resistant force produced on the chain 40 (via the hour part 10 to which the latter is attached) by the resistant torque generated by the hour spring 19, tends to displace the hour part 10 in rotation in the direction indicated by the arrow Z1 in FIG. 3 and consequently keeps it in its resting position, the end of the external arm 17 (to which the chain 40 is attached) being locked against the return bearing 45.

The repeater 5 is actuated by the wearer by means of pressure exerted radially on the push button 77, in the direction of the centre of the middle 2 (white arrow, at the bottom in FIG. 9 and in FIG. 10).

The push button 77 comes to press on the button 71 which it displaces by making the rack 66 pivot about its axis A5, via the lever 70, in the direction indicated in FIG. 9 and FIG. 10 by the arrow F1.

The rack 66, which meshes with the input pinion 73, causes the latter to rotate in the direction indicated in FIG. 9 by the arrow F2. The multiplier pinion 75, which is integral in rotation with the input pinion 73, turns in the same direction (arrow F3). It meshes, in its turn, with the output pinion 74 which is set in rotation in the opposite direction (arrow F4).

The barrel shaft 33, integral with the output pinion 74 and the ratchet 47, drives the latter in the direction of rotation of the output pinion 74 (arrow F5, FIG. 10), while arming the barrel spring 35. In fact, the barrel shaft 33 sets in its rotation the internal end 36 of the barrel spring 35 whilst the external end 37 of the latter remains fixed in rotation with the barrel drum 34, which is retained by the ratchet 58 in engagement with the toothed crown 57.

During this time, the chain 40 is pulled (arrow Y2, FIG. 3 and arrow F6, FIG. 10) by the hour part 10, which is returned (arrow Z2, FIG. 3) by the hour spring 19. The effect of this traction is to make the pulley turn (arrow X2, FIG. 3 and arrow F7, FIG. 9 and FIG. 10) since the ratchet 47 no longer retains it and the hour spring 19 exerts on the hour part 10 a motor torque which is greater than the resistant torque (arrow F8) exerted on the pulley 38 by the pulley spring 60. As long as the hour part 10 has not reached its reading position, the pulley 38 can follow its rotation, allowed by the rotation of the ratchet 47. During this entire time, the limit stop 65 remains abutting against the tooth 59 of the ratchet 47.

For any read hour other than 12h59, the hour part 10 reaches its reading position before the rack 66 reaches its complete armed position. Then, the hour part 10 no longer exerts traction on the chain 40 which for its part no longer exerts a motor torque on the pulley 38. However, moved by the rack 66 via the striking mechanism train 68, the ratchet 47 follows its rotation in the direction indicated by the arrow F5, so that the tooth 59 is offset angularly from the limit stop 65. As the pulley spring 60 retains, whatever the angular position relative to the ratchet 47 and the pulley 38, a torque reserve, it continues to exert a resistant torque (arrow F8, FIG. 12) on the pulley 38 which, instead of becoming slack and allowing the chain 40 to float, keeps the latter under tension (arrow F10, FIG. 12).

When the read hour is 12h59, the hour part 10 reaches its reading position at the same time as the rack 66 reaches its complete armed position. The limit stop 65 of the pulley 38 remains in contact with the tooth 59 of the ratchet 47 over their entire angular course, and the chain 40 remains permanently tensioned.

However, the pressure on the push button 77 is maintained until the rack 66 has reached its complete armed position when the limit stop 76 comes to abut against the input pinion 73 (FIG. 11). From the point of view of the wearer, the push button 77 (and therefore the striking mechanism) functions on an all-or-nothing basis, i.e. the push button 77 must be completely depressed whatever the hour to be struck.

When the push-button 77 is released, the barrel spring 35, the external end 37 of which has remained (and remains) fixed, returns the barrel shaft 33 (and therefore the ratchet 47) towards its initial position. When the read hour is 12h59, the tooth 59 is applied against the limit stop 65 and the ratchet 47 immediately sets the pulley 38 in its rotation. For any read hour other than 12h59, the ratchet 47 firstly pivots about the axis A4 of the barrel without actuating the pulley 38 until the tooth 59 comes in contact with the limit stop 65. Then, the pulley 38 and the ratchet 47 are again integral in rotation, and are jointly returned towards their initial position (arrow X1, FIG. 3) by the motor torque exerted on the barrel shaft 33 (and therefore the ratchet 47, and therefore the pulley 38) by the barrel spring 35, this motor torque being much greater than the resistant torque exerted on the hour part 10 by the hour spring 19. The result is that the chain 40 is pulled (arrow Y1, FIG. 3) by the pulley 38 on which it is wound up gradually during the rotation of the latter, until the hour part 10, returned towards its resting position (arrow Z1, FIG. 3) has regained the latter by coming to abut against the return bearing 45.

Having reached its resting position, the hour part 10 locks the chain 40 which for its part locks the rotation of the pulley 38 which locks the rotation of the ratchet 47, which locks the rotation of the barrel shaft 33 and with it the striking mechanism train 68 and the rack 66. The push button 77, pushed back by the rack 66 via the button, regains, for its part, its resting position. The repeater 5 is thus locked.

During the entire course accompanying the release of the push button 77, the hour part 10, the quarter part 22 and the minute part 24 have, together (and in the manner explained above), struck the displayed hour.

The advantages obtained by the repeater 5 are decisive: therefore when the push button 77 functions on an all-or-nothing basis, and when it is pushed fully down whatever the hour to be struck, the chain 40 remains permanently retained under tension. Apart from the aesthetic aspect (the floating of the chain might be considered as a fault by the demanding amateur), the stress peaks undergone by the chain 40 are avoided, to the benefit of its lifespan—and that of the assembly of the repeater 5. In the end, the mechanical fatigue undergone by the chain 40 and the assembly of mobile parts of the repeater 5 is limited.

What is claimed is:

1. A repeater mechanism for a timepiece with a striking mechanism, which comprises:

an hour snail;

an hour part bearing an hour feeler-spindle and mounted in rotation about an hour axis between:

a resting position in which the hour feeler-spindle is offset angularly from the hour snail;

a reading position in which the hour feeler-spindle comes in contact with the hour snail;

an hour spring which returns the hour part towards its reading position;

a striking mechanism barrel, which comprises:

a barrel shaft;

a barrel drum, a barrel spring, an internal end of which is integral with the barrel shaft and an external end of which is integral with the barrel drum;

a pulley;

a chain which is able to be wound up partially on the pulley, the chain being hooked, by a proximal end, on the pulley and, by a distal end, on the hour part;

wherein the pulley is mobile in rotation relative to the barrel shaft, and the striking mechanism barrel comprises:

a ratchet, integral in rotation with the barrel shaft and:

coupled in rotation with the pulley as long as the hour part exerts a traction force on the chain;

uncoupled in rotation from the pulley as soon as the traction force exerted on the chain by the hour part in the reading position is cancelled out;

a pulley spring interposed between the ratchet and the pulley, and which exerts on the latter a resistant torque which keeps the chain under tension when the ratchet is uncoupled in rotation from the pulley.

2. Mechanism according to claim 1, in which the pulley spring is a spiral spring, an internal end of which is integral with the ratchet, and an external end of which is integral with the pulley.

3. The mechanism according to claim 1, wherein the pulley integrates a limit stop, and the ratchet integrates a tooth which is applied against the limit stop as long as the chain exerts a traction force on the pulley, and which is offset angularly therefrom as soon as the traction force exerted on the chain by the hour part in the reading position is cancelled out.

4. The mechanism according to claim 1, which furthermore comprises:

a rack mounted in rotation about an axis and provided with a toothed sector;

a striking mechanism train meshing, on the one hand, with the toothed sector of the rack and, on the other hand, with the barrel shaft.

5. The mechanism according to claim 4, in which the striking mechanism train comprises an input pinion which meshes with the toothed sector of the rack, and an output pinion which is integral in rotation with the barrel shaft.

6. The mechanism according to claim 5, wherein the striking mechanism train comprises a multiplier pinion which is integral in rotation with the input pinion and meshes with the output pinion.

7. A watch equipped with a middle, the repeater mechanism according to claim 4 and a push button mounted in translation on the middle between a disarmed position in which the push button does not exert a motor torque on the rack, and an armed position in which the push button exerts a motor torque on the rack which causes rotation of the barrel shaft via the striking mechanism train.

8. The mechanism according to claim 1, which comprises a locking pawl which is in engagement with a toothed crown with asymmetrical toothing carried by the barrel drum.

9. The mechanism according to claim 1, which comprises a return bearing on which the chain runs between the striking mechanism barrel and the hour part.

10. A watch equipped with a middle and the repeater mechanism according to claim 1, mounted in the middle.

* * * * *